US005503399A

United States Patent [19]

Honeywill

[11] Patent Number: 5,503,399

[45] Date of Patent: Apr. 2, 1996

[54] CAREER GAME

[76] Inventor: Roberta L. Honeywill, Unit 1/3 Maretimo Street, Balgowlah, New South Wales, Australia, 2093

[21] Appl. No.: 385,665

[22] Filed: Feb. 8, 1995

[30] Foreign Application Priority Data

Feb. 8, 1994 [AU] Australia ..... PM3724

[51] Int. Cl.[6] ..... A63F 3/00

[52] U.S. Cl. ..... 273/243; 273/256

[58] Field of Search ..... 273/242, 243, 273/256, 273

[56] References Cited

U.S. PATENT DOCUMENTS

| | | | |
|---|---|---|---|
| 748,626 | 1/1904 | Magie | 273/256 |
| 4,189,153 | 2/1980 | Zollinger | 273/256 |
| 4,431,195 | 2/1984 | Brand et al. | 273/256 |
| 4,501,425 | 2/1985 | Alvarado | 273/256 |
| 4,936,589 | 6/1990 | Sinclair | 273/256 X |
| 5,407,207 | 4/1995 | Stanford | 273/256 |

FOREIGN PATENT DOCUMENTS

| | | | |
|---|---|---|---|
| 1258689 | 8/1989 | Canada | 273/256 |

OTHER PUBLICATIONS

Monopoly, Rules of Play, pp. 1–10, © 1935.
Trivial Pursuit, Rules of Play, pp. 1–6, © 1994.

*Primary Examiner*—William E. Stoll

*Attorney, Agent, or Firm*—Brumbaugh, Graves, Donohue & Raymond

[57] ABSTRACT

Disclosed is an instructional game in which participants may be exposed to a multitude of careers or occupations and also participants may be exposed to a variety of predicaments which are to be encountered in a working life. An apparatus for a game is provided the apparatus comprising:

a game board divided into a plurality of compartments, the compartments being located on the game board in the form of a path to be followed by participants in the game, each compartment including a reference to a respective business predicament and positive/negative consequence indicators;

a plurality of question cards, with each question having a selection of possible answers;

whereby a participant landing on a compartment is required to define the meaning of the business predicament represented in the square, and, on producing an answer deemed to be correct, is required to answer the question on a selected question card, the participant acquiring a positive or negative consequence as a result of correct and incorrect answers respectively.

12 Claims, 10 Drawing Sheets

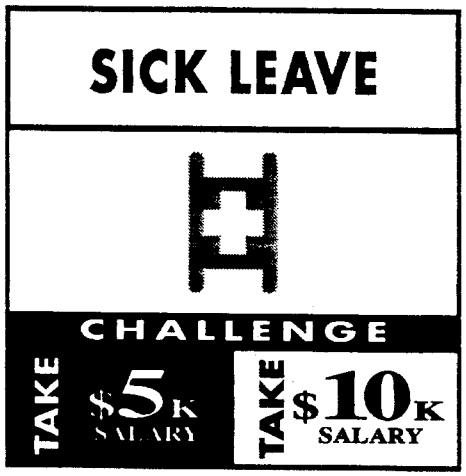
FIG. 2a
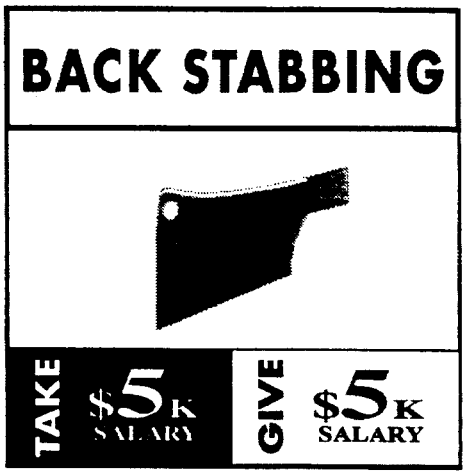
FIG. 2b
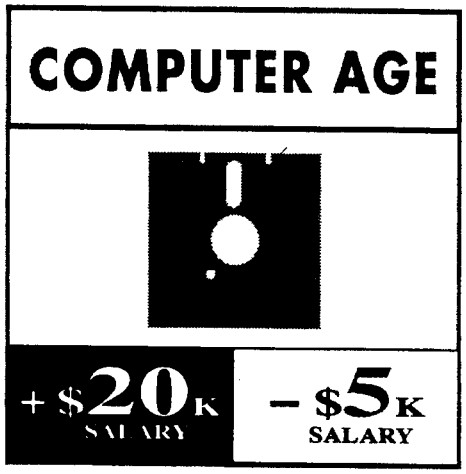
FIG. 2c
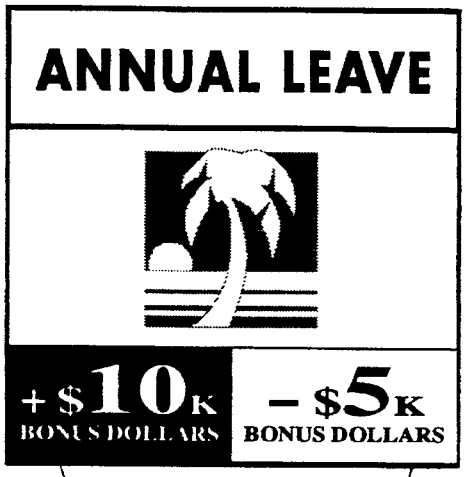
14 FIG. 2d 14
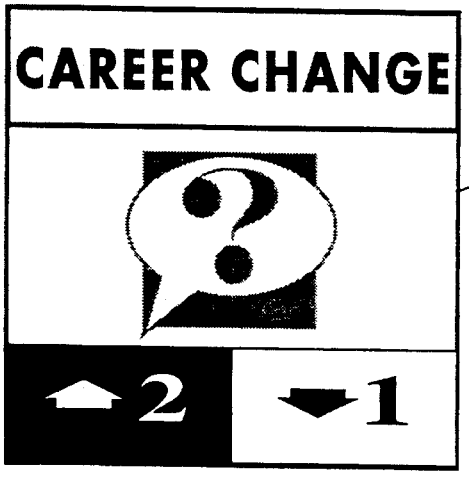
12
FIG. 2e

AIRCRAFT LOADER

*Question No.:* 220

What is the name of the vehicle used to transport luggage to and from the aircraft?

A. A bug.
B. A tug.
C. A mini minor.
D. A luggage mobile.

LEVEL 1234

JOURNALIST

*Question No.:* 227

Which occupation would be *least* indicative of a specialisation in journalism?

A. Leader writers
B. Feature reporters
C. Columnists
D. Cadet writer

LEVEL 12

20

VALUER (REAL ESTATE)

*Question No.:* 233

Upholsterer is to fabric as valuer is to:

A. Value.
B. Report.
C. Consult.
D. Expensive.

LEVEL 1

WEAVER

22

*Question No.:* 185

You need to thread the shuttles. What do you do?

A. Use your hands.
B. Use your assistant.
C. Use a gaver strap.
D. Use a weft arm.

LEVEL 4

24

ZOOLOGIST

*Question No.:* 239

Which study does *not* fit with the definition of a zoologist:

A. Entomology.
B. Ornithology.
C. Ichthyology.
D. Mycology.

LEVEL 1

STAGE HAND (THEATRE)

*Question No.:* 218

If you are operating the "flys" what are you doing?

A. Assembling the performing blowies for their entrance.
B. Raising and lowering the curtains.
C. Raising and lowering of large screens on rope that form part of the stage scenery.
D. Raising and lowering the people attached to flying mechanisms.

LEVEL 4

FIG. 3a

GENERAL BUSINESS

*Business Term* *Question No.:* 52

The act of paying off a loan or mortgage is called a:

A. redemption

B. pay-out

GENERAL BUSINESS

*Business Term* *Question No.:* 63

Spot goods are:

A. goods that are available for immediate delivery.

B. goods in which the delivery is arranged for a fixed date in the future.

26

GENERAL BUSINESS

*Business Term* *Question No.:* 14

A creditor is:

A. a person or organisation that you owe money to.

B. a person or organisation that owes money to you.

GENERAL BUSINESS

*Business Term* *Question No.:* 70

A written and signed statement of facts to be produced as evidence in a court of law is:

A. a subpoena

B. an affidavit

FIG. 3b

GENERAL BUSINESS

*Business Term* *Question No.:* 34

Liquidate means:

A. to invest money to open a company.

B. to sell company assets and convert into cash.

GENERAL BUSINESS

*Business Term* *Question No.:* 29

Gross income is:

A. the amount of money received by a person or organisation in the form of wages, profit or interest before tax.

B. the amount of money received by a person or organisation in the form of wages, profit or interest after tax.

26

SALARY DOLLARS

| SALARY | +/- | AMOUNT | |
|---|---|---|---|
| $ 10,000 | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |

BONUS DOLLARS

| BONUS DOLLARS | +/- | AMOUNT | |
|---|---|---|---|
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |
| $ | +/- | | A B C D |

*How to use the scorecard:*

| | | | |
|---|---|---|---|
| $ 10,000 | ⊕/- 20,000 | | A B C D |
| $ 30,000 | +/- | | A B C D |
| $ | +/- | | A B C D |

*The left hand column should always carry your subtotal.*

*The space to the right of the plus/minus symbol should always carry the amount you gained or loss on a specific turn. The letters ABCD are there for you to process of eliminate the letters which are not the correct multiple choice answer for that question card.*

*Do not confuse salary dollars with bonus dollars (the right hand column).*

*For example, on your first turn you earned $20,000 salary, circle the "+" symbol write $20,000 to the right of the plus, then on the next line write in your subtotal of $30,000.*

POSITION & SALARY CHART

| | |
|---|---|
| Despatch | $10,000 |
| File Clerk | $15,000 |
| Desk Clerk | $16,000 |
| Secretary | $18,000 |
| Executive Secretary | $22,000 |
| Personal Assistant to G.M. | $28,000 |
| Salesperson | $30,000 |
| Purchasing Officer | $31,000 |
| Office Manager | $33,000 |
| Supply & Distribution Manager | $35,000 |
| Production Manager | $40,000 |
| Personnel Manager | $45,000 |
| Operations Manager | $50,000 |
| R&D Technical Manager | $55,000 |
| Sales/Marketing Manager | $60,000 |
| Legal Manager | $65,000 |
| Public Policy Manager | $70,000 |
| Finance Manager | $80,000 |
| General Manager | $100,000 |
| 2nd I.C. to Managing Director | $125,000 |
| Managing Director | $150,000 |
| Company Director | $175,000 |
| **Chief Executive Officer (C.E.O.)** | $200,000 |

30

FIG. 4

CONTENTS OF MASTER BOOK:

1. DEFINITION OF EACH COMPARTMENT
2. DEFINITION OF EACH OCCUPATION
3. RULES OF PLAY
4. ANSWER KEY

CAREER GAME

FIELD OF THE INVENTION

The present invention relates to a game.

In particular, the present invention relates to an instructional game in which participants may be exposed to a multitude of careers or occupations and also participants may be exposed to a variety of predicaments which are to be encountered in a working life.

BACKGROUND OF THE INVENTION

It is anticipated that the game of the invention described herein will, by way of being diverting entertainment, provide a means whereby those involved in the process of making decisions about careers will be informed and educated as to the necessary qualifications required, and likely difficulties to be encountered by those in any particular occupation. Thus, the game of the present invention is expected to be particularly useful to school children and adolescents in their senior years as well as migrants, short and long term unemployed, adults re-entering the workforce as well as for general entertainment.

The purpose of the game is threefold. First, to provide an educational tool that is representative of industry and provides a learning forum for students, migrants, adults re-entering the workforce, unemployed persons and families to develop or improve their logic (deductive reasoning, expertise, skill and knowledge) as it pertains to business which could result in a more effective transition from unemployment to employment. Second, to make known to the persons who participate in the game certain employee obligations and entitlements. Third, to expose a number of occupations (over 1000) to enable persons who participate in the game to be aware of the variety of occupations available and the necessary qualifications to enter any specific occupation.

Having defined the meaning of an occupation the game then also provides a method of exposing the individuals in the game to situations or predicaments within specific occupations and by use of questions with multiple choice answers allowing the individual to develop and practice the use of logic as it pertains to the specific occupation and consideration and by extension to other occupations.

It can be seen therefore that by playing the game an individual will not only be entertained but would also develop a body of knowledge which would be useful at a later date by enhancing logic as it pertains to employment or in the process of career selection.

SUMMARY OF THE INVENTION

Therefore the present invention provides an apparatus for a game to be played by a number of participants, the apparatus comprising:

a game board divided into a plurality of compartments, the compartments being located on the game board in the form of a path to be followed by participants in the game, each compartment including a reference to a respective business predicament and positive/negative consequence indicators;

a plurality of question cards, with each question having a selection of possible answers;

whereby a participant landing on a compartment is required to define the meaning of the business predicament represented in the square, and, on producing an answer deemed to be correct, is required to answer the question on a selected question card, the participant acquiring a positive or negative consequence as a result of correct and incorrect answers respectively.

The correctness of the definition of the business predicament provided by the participants is decided by reference to a definition provided for each predicament in a master book, the master book also containing the correct answers to each of the questions posed on the question cards.

Thus the game enables the participants to learn by being exposed to various predicaments what possible outcomes of a specific situation there might be and also which of those outcomes lead to a positive consequence in terms of salary and career progression. By this method it could be anticipated that individuals participating in the game will learn appropriate responses to situations and will by comparing one situation to another will be able to deduce logically what might be appropriate responses in any new situation.

Appropriate selection of both the business predicaments to be defined in each of the compartments of the board and the scenarios included in the question cards makes known to the participants certain employee obligations and entitlements.

Similarly, the inclusion in a master book of descriptive information relating to each of the occupations referred to in the question card, including the qualification requirements for the occupation enables those who participate in the game to become aware of the variety of occupations available and the necessary qualifications to enter the occupation.

Preferably the participants in the game all commence the game in a predetermined initial occupation and salary. The positive/negative consequence indicators being salary/bonus increases or decreases respectively, and promotion or demotion is able to achieve promotion to a higher occupation and salary by accumulation of salary increases acquired through providing correct answers to questions.

Preferably the game includes a further element wherein a proportion of the questions are challenge questions, there being no correct answer supplied on the question card, the answer being judged for correctness by other participants in the game.

The questions may be limited to the categories simple, varied/general, industry specific and professional specific. The correct answer may be selected by one of two multiple choice answers. Alternatively all questions may be industry specific, limited to a single occupation.

Preferably the game is played by players moving around the board from compartment to compartment based on a score obtained from any means for generating scores such as a dice.

Preferably the game may be played to a conclusion whereby one individual becomes the first player to obtain a predetermined career climax, when that player has reached a predetermined occupation and salary.

In some embodiments of the present invention, the playing surface may be represented by a banner board to be attached to a substantially vertical surface, for example, a black board, thereby enabling a large number of participants, such as a class, to play in the game. Alternatively, the game playing surface may be formed on a transparency to be used on an overhead projector.

In further embodiments of the game, the game may be provided in electronic software form. Where the game apparatus is supplied in electronic form, the question card and Master Book may be provided in the form of readable database libraries, the game board appearing as an image generated on one or more computer screens of computers locally or remotely located and networked.

As will be appreciated, the game of the present invention is an educational tool in addition to an entertainment. To function optimally as an educational tool the business predicament represented and the nature of the questions may be selected with particular participants in mind, for example, for younger children and those with learning or language difficulties for whom relatively simple questions with only a limited choice of answers are deemed appropriate. Similarly, for those at executive level or with a range of business experience an 'advanced' level of questions would be more appropriate.

The present invention will now be described by reference to the following non limiting example in which:

BRIEF DESCRIPTION OF THE DRAWINGS

FIGS. 2*a*–2*j* illustrate in some detail examples of compartments of the board of FIG. 1;

FIGS. 3*a*, 3*b* and 3*c* illustrate a number of question cards relating to various scenarios categorized as regular, general business and challenge question cards;

FIG. 4 indicates a score card which may be used by players in determining a score total for the game;

DESCRIPTION OF PREFERRED EMBODIMENT

Figure 1:
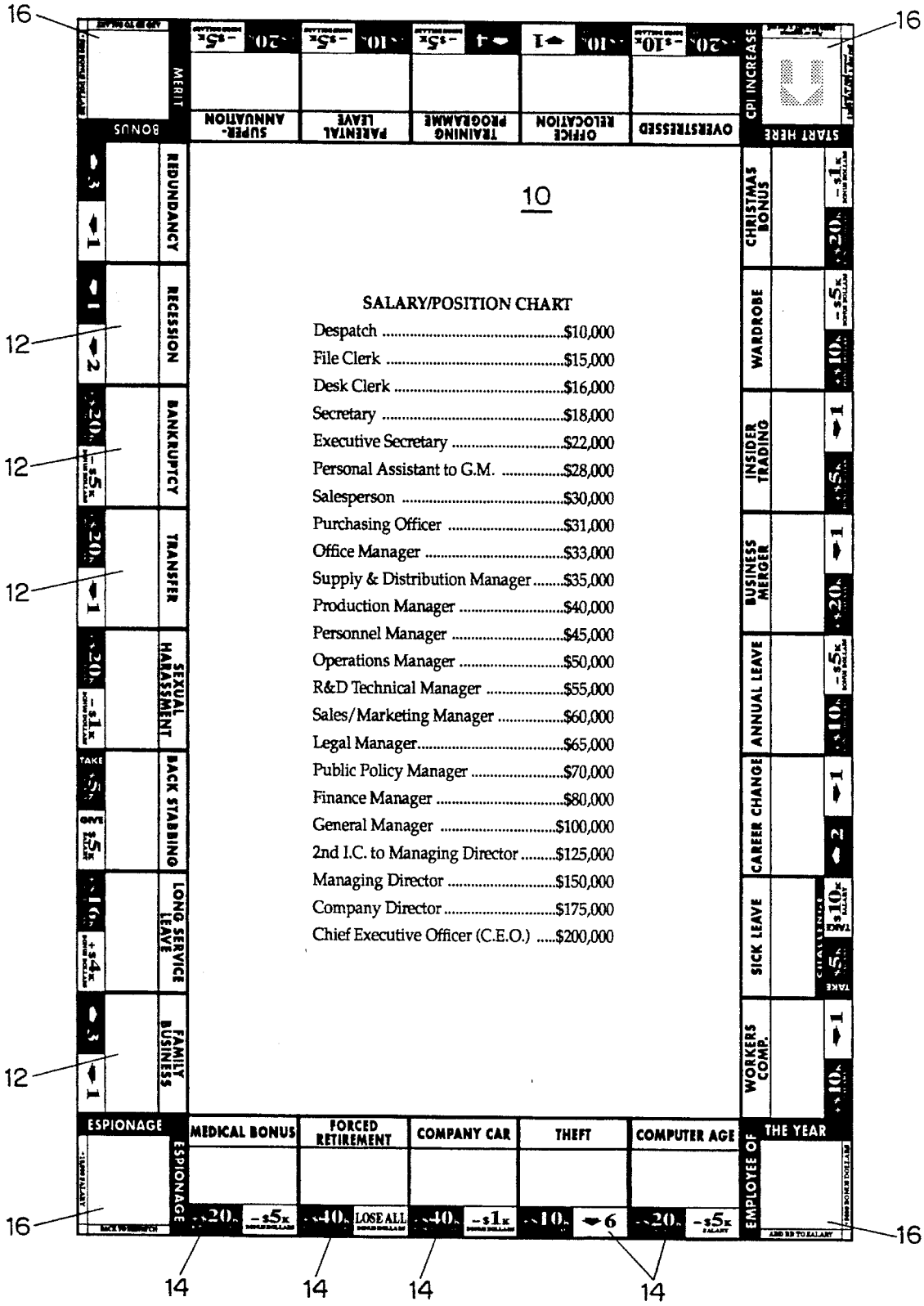
FIG. 1 illustrates a board layout forming a part of the apparatus for playing the game of the present invention.
Figure 2F:
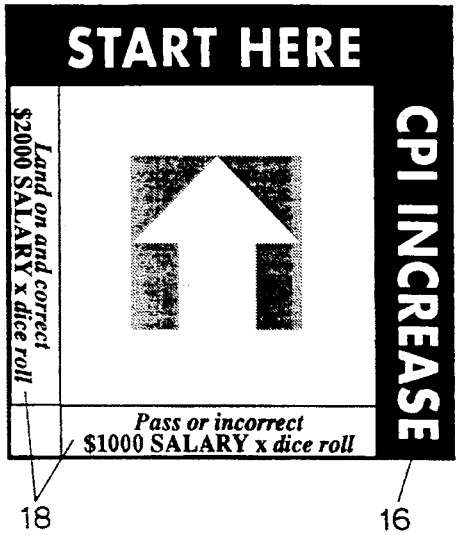
Figure 2G:
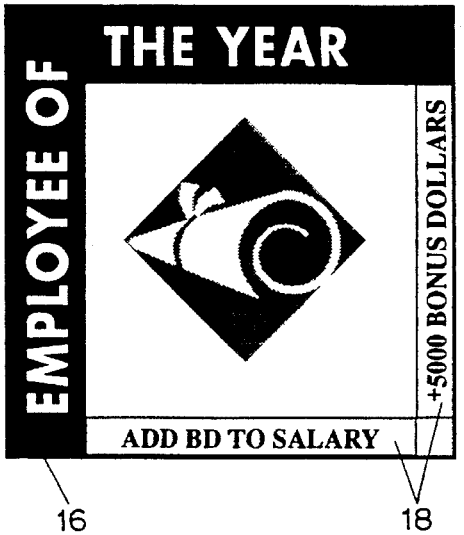
Figure 2H:
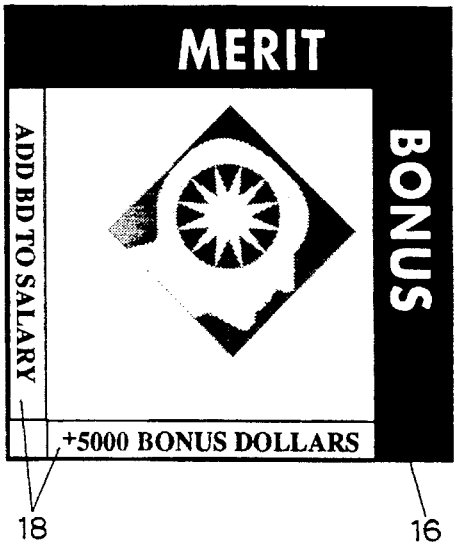
Figure 2I:
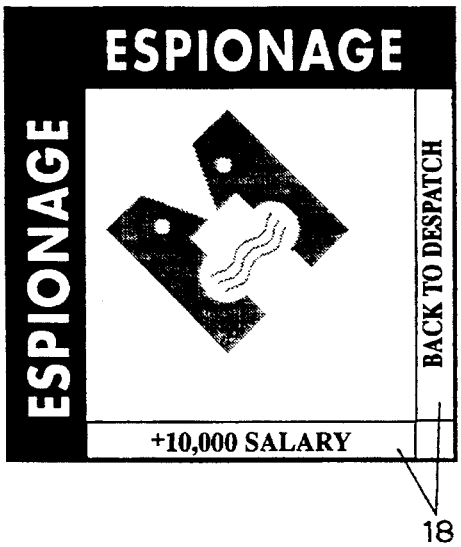

Shown in FIG. 1 is a game board 10 which includes a number of compartments 12 arranged in a square fashion around the edges of the board 10.

Each compartment 12 describes a predicament which could possibly be encountered by any working person. These predicaments may be universal for example, "Recession" or "Superannuation"; alternatively, a predicament may relate to an industry or an industry group such as "Insider Trading"; or the predicament may be a more personal one effecting only one company or one individual such as "Computer Age" or "Company Car".

Figure 7:
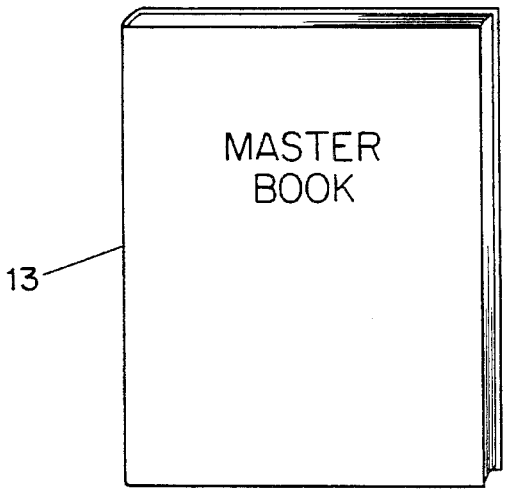
FIG. 7 illustrates the Master Book design and lists the contents within the Master Book.

A Master Book 13 as illustrated in FIG. 7, gives a detailed description following accepted business and government definitions of the particular predicaments referred to in each compartment 12. In the examples shown there are 30 compartments on the board each compartment having a separate predicament. The Master Book also defines every occupation represented in the question cards as well as the answer key to locate the correct multiple choice answer to any one question card.

The compartments 12 also include an illustration, omitted from FIG. 1 for purposes of clarity, but clearly shown in FIGS. 2*a*–2*e*, which in some way makes reference to the predicament, such as a floppy disk for computer age and a handshake for business merger. The compartments 12 also include divisions 14 that make a reference to a positive or negative consequence. These consequences refer to the questions to be described later. The consequences are given in dollar terms as either increases (+) or decreases (–) of salary or of bonus dollar amounts or alternatively as a promotion or demotion which then equates to a physical salary located on the position/salary chart.

The game board 10 further includes four corner compartments 16. The corner compartments 16 are illustrated in greater detail in FIGS. 2*f*–2*i*. The corner compartments 16 are labelled START HERE-CPI INCREASE, EMPLOYEE OF THE YEAR, ESPIONAGE and MERIT BONUS respectively. The corner compartments 16 also each have respective positive or negative consequence indicators, shown generally at 18. By contrast with the positive/negative consequence indicators 14, the consequence indicators 18 may also have consequences other than salary or bonus dollar amounts. For example, the compartment labelled ESPIONAGE has a consequence "Back To Despatch."

FIG. 3*a* illustrates by way of example some of the question cards 20 used in the game. Approximately 1000 question cards may be supplied with each game and the questions may be delineated according to the estimated degree of difficulty required in answering the questions. The question cards serve a number of functions.

First, they relate to particular occupations for example antique dealer, a painter and so on, the occupation indication being found in a band 22 located at the upper edge of the cards 20. Second, the definitions of the occupations are supplied with the game and collated in the Master Book. Third, on each question card a "LEVEL" indicator 24 is given for the particular occupation. The level indicator 24 relates to the educational requirement for the specific occupation. The levels are designated from level 1 which indicates, for example, matriculation and completion of tertiary (or college) education or another bachelor's diploma course; level 2 which indicates matriculation and attainment of an associate diploma/certificate plus on-the-job training or equivalent; level 3 which indicates Year 10 or 11 (or high school education) and part-time study or on-the-job training; and finally, level 4 which requires no specific training usually on-the-job training.

Thus by playing the game the participants involved are forced to consider a number of business predicaments such as recession or superannuation and also a number of occupations, the definitions of the occupations and the educational requirements to enter any particular occupation. As well as become adept in problem solving and be aware of the employment structure of a business which may, or may not, include all or some of the positions/salaries stated within the game.

Finally, each question card 20 carries a question relating to a scenario which might be expected to occur in the particular occupation. The questions are written with a number of aims in mind, namely, to be entertaining, to include information about the occupation and to promote the use of logical thought by the participants arriving at an answer. The questions are accompanied by a number of possible answers and it is the job of the players of the game to select a particular answer. The correct answer can be found by reference to the Master Book 13.

There are some question cards 26 that do not deal with a specific occupation. These are called General Business question cards and are illustrated in FIG. 3*b*. There is no level indicator for the General Business question cards 26. The content of the questions on the General Business question cards 26 pertain to general business practice and terminology and they are applicable to a variety of occupations. The answers to the questions posed on the General Business cards are again to be found in the Master Book 13.

Figure 3C:
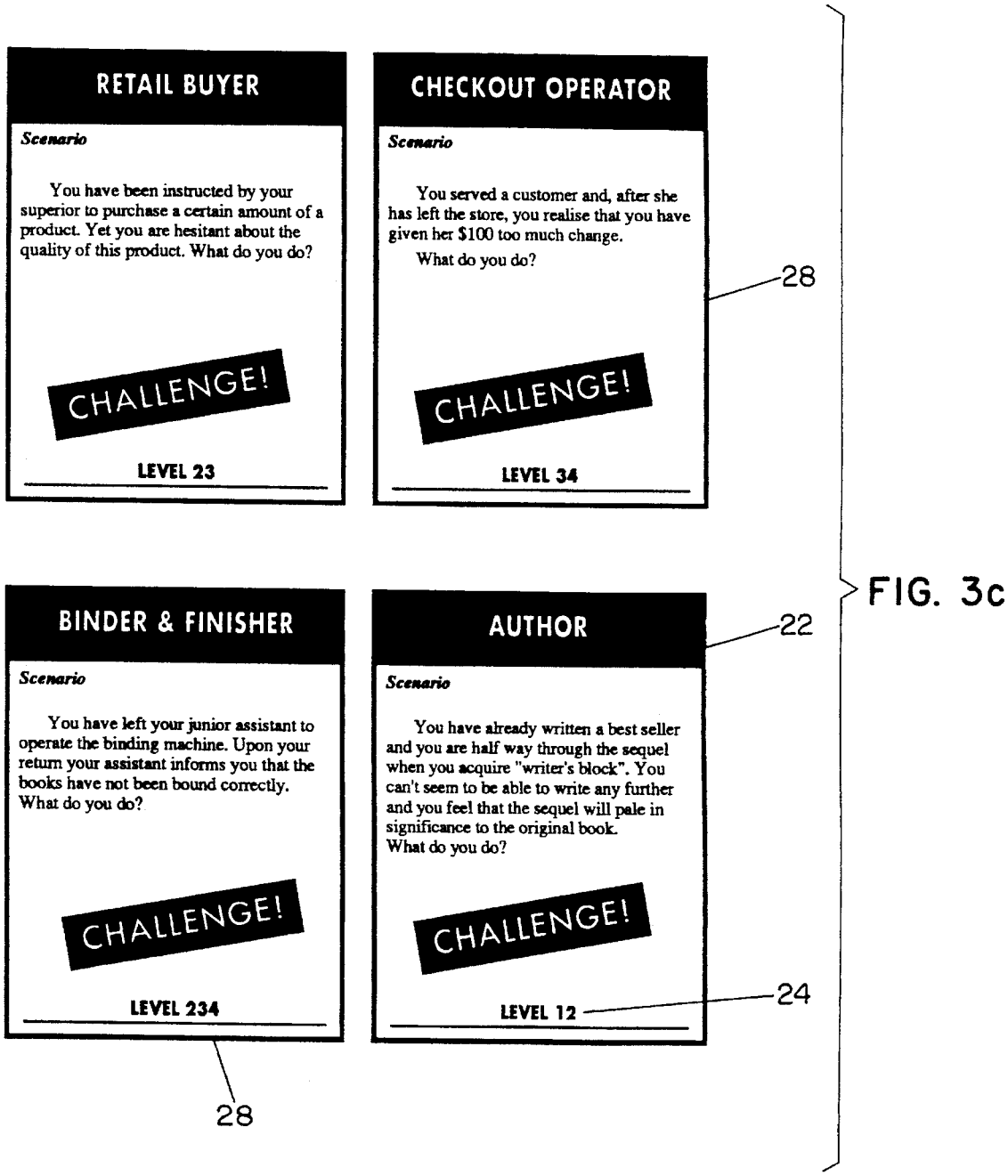

A third type of question card, namely Challenge! card 28 is illustrated in FIG. 3*c*. Challenge! cards 28 are occupation specific and include a an occupation indicator 22. However, the questions are less factually based and present the participants with a ethical or moral dilemma which could be encountered in the occupation identified. There are no prescribed answers to these questions, but a judgement is made by the other participants in the game as to the appropriateness of the response. By presenting the participants with such situations it is expected that the participants could develop the ability to deal with such situations and assess the possible outcomes of differing responses to the situations.

The set of cards which total no less than 250 that will be sorted and packaged according to level of difficulty and combined with or separate to the game board. Levels of difficulty include but are not limited to categories of simple, varied/general, industry specific, and professional specific.

The consequence of a right or wrong answer may be found by referring to the positive or negative consequence indicators 14 for the particular compartment 12 on which the player is standing. A right answer can lead to an increase in salary or a promotion to a higher position and a wrong answer can lead to a decrease in salary or a demotion. There may also be provision for no change in salary but simply a career stabilization. If a player is unfortunate enough to be standing in the Espionage compartment and to select an incorrect answer the consequence is that the player is demoted to the original starting position of Dispatch.

The scores obtained by playing the game may be tallied using a score card 30 illustrated in FIG. 4 by which the players may record any salary increases or decreases. The approximate salary of the player for any particular occupation is noted on the score card. The aim of the game is to proceed from the initial position of Despatch, salary $10,000 through to the pinnacle of the game of Chief Executive Officer, salary $200,000.

Figure 5A:
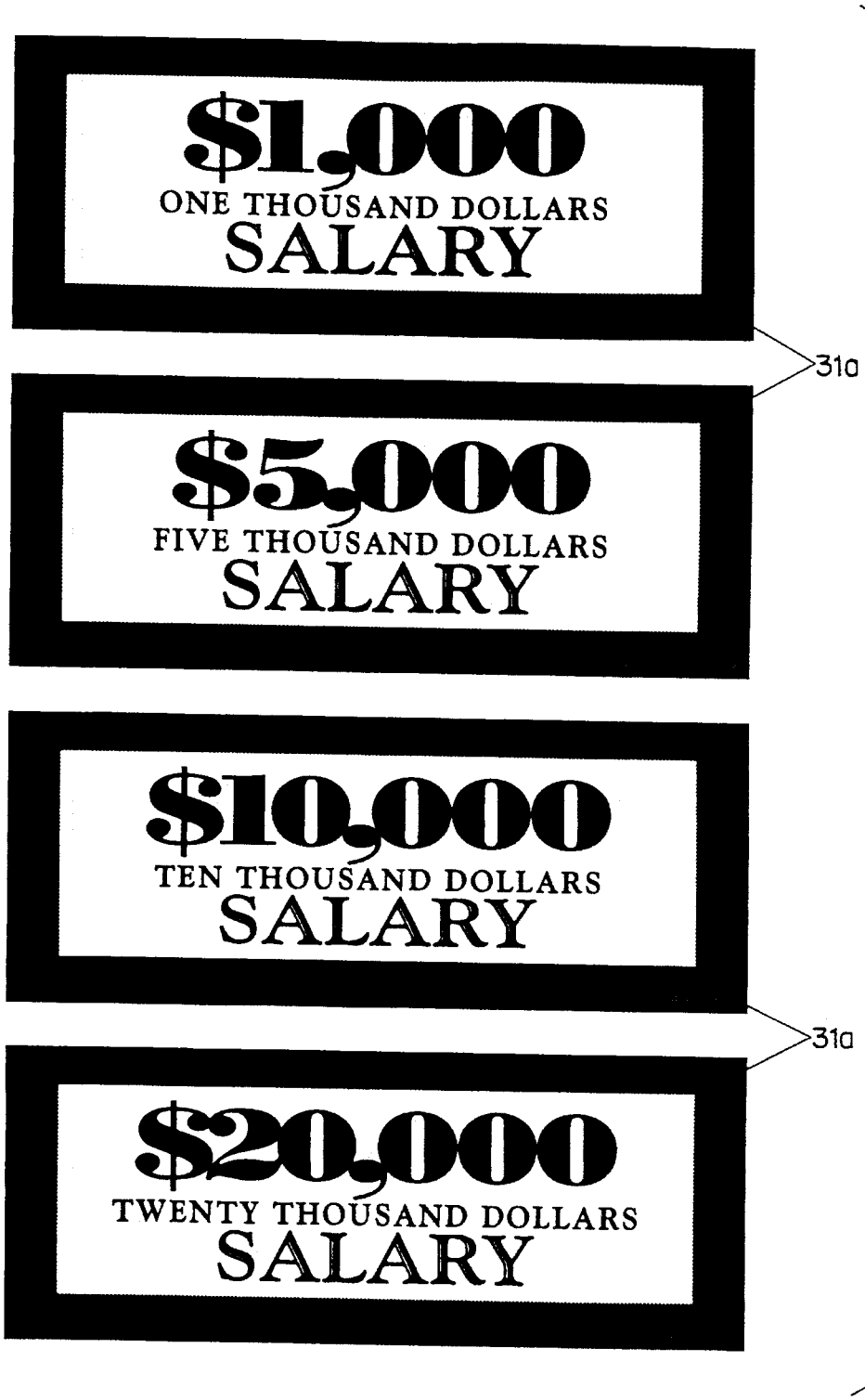
FIG. 5 illustrates physical salary and bonus dollars which can be used with the game.
Figure 5B:
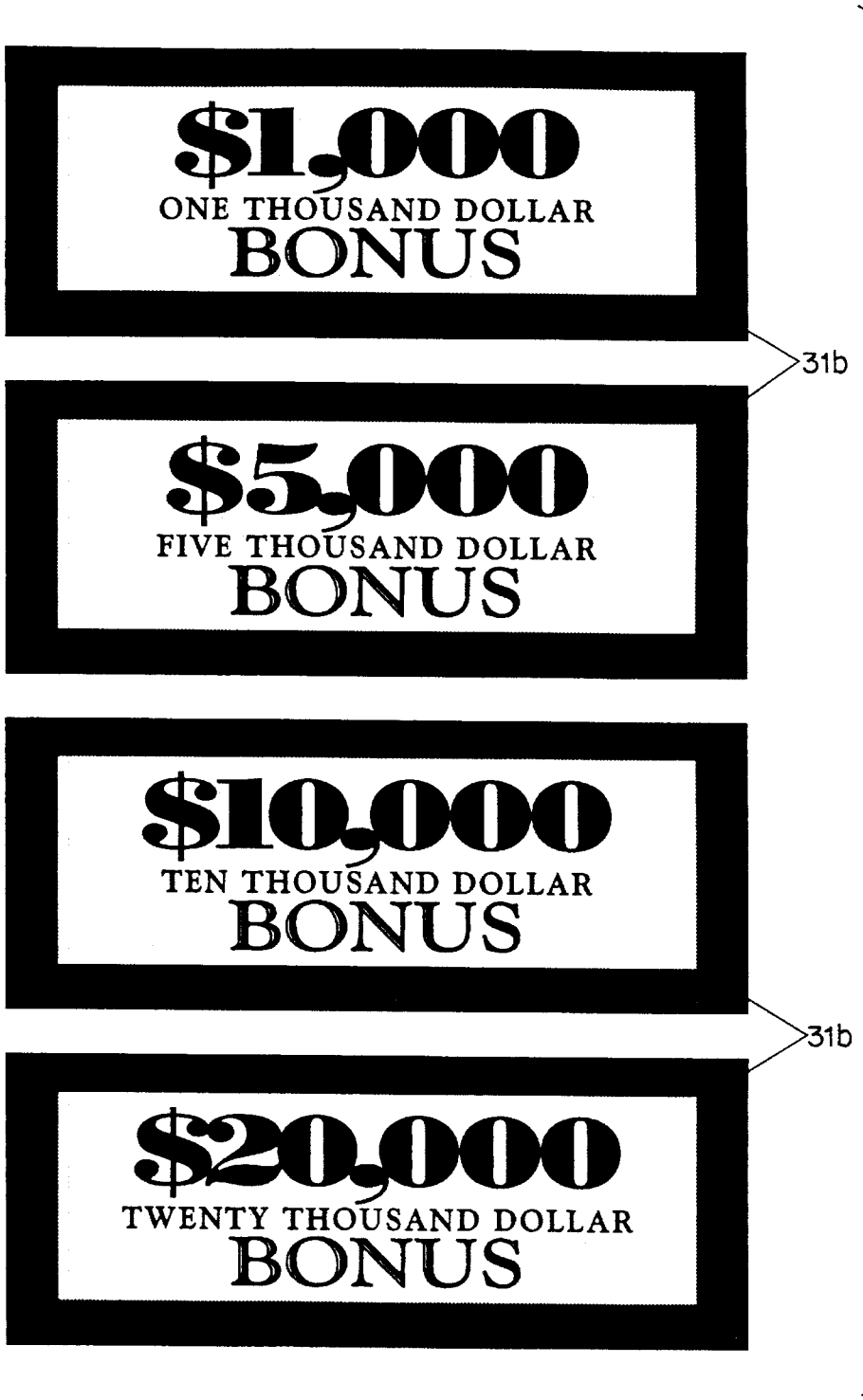

As an alternative to the score card the game may be played using reference to physical dollar amounts which may be obtained from or paid to a banker and each player keeping their respective dollars. The denominations of $1,000, $5,000, $10,000 and $20,000 enable a player to change salary easily. Shown in FIGS. 5*a* and 5*b*, salary dollar certificates 31*a* and bonus dollar certificates 31*b* can also be delimited by using separate colors.

Figure 6:
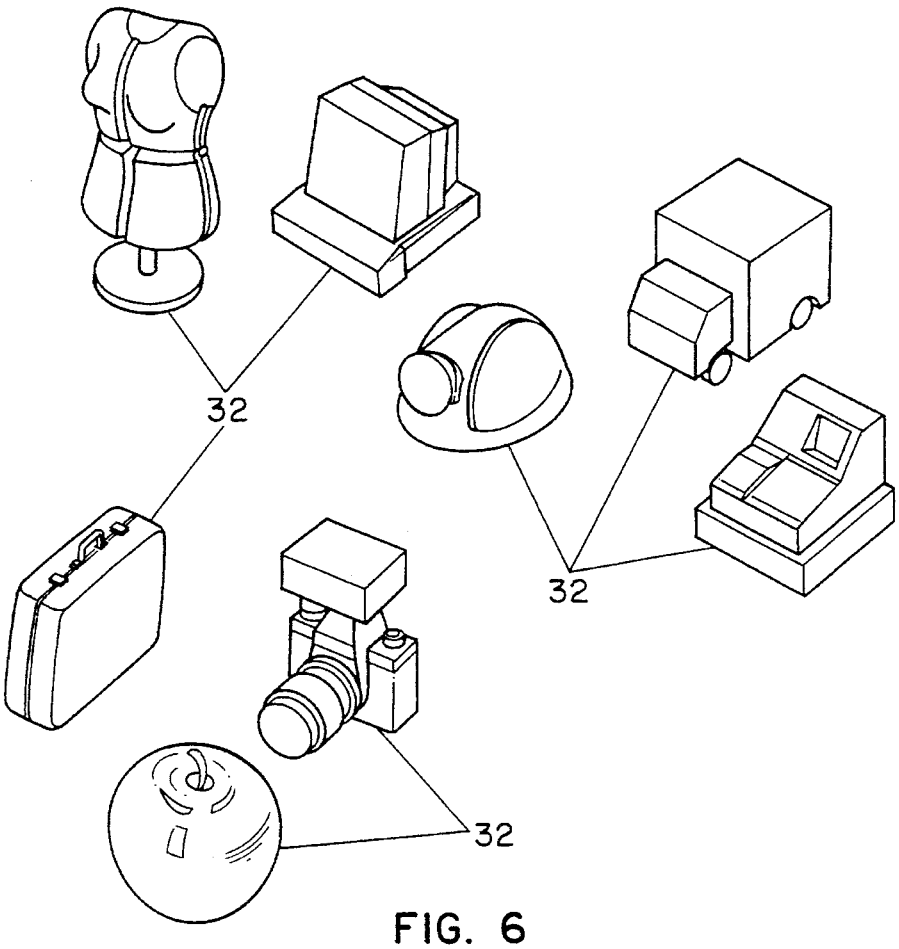
FIG. 6 illustrates physical tokens in side elevation for use in the game and indicative of various careers.

In order that the participants move around the game board 10, each player is provided with a physical token 32. Examples of the tokens are shown in FIG. 6. The tokens are in some way representative of occupations eg, cash register for a shop assistant, an apple for a teacher, a computer for a secretary, a miners hat and so on. Moreover to enable the game to be played a means for generating scores is provided typically in the form of dice.

In use the game is played according to the following instructions.

Prior to beginning the game the participants need to agree on the amount of time allocated to each participant to answer a question card, alternatively the time can be left to the discretion of the participants while in play.

1. Each player starts out in DESPATCH with a salary of $10,000.

2. Utilizing the dice, each participant rolls, the participant with the highest number goes first and the playing turns go clockwise.

3. All tokens must be placed on the corner compartment 16, titled CPI INCREASE.

4. Once you have landed on a compartment 12 the participant must define the business predicament indicated in the compartment in order to qualify for a question card (i.e. RECESSION is a period of adverse economic circumstances, usually less severe than a depression). Failure to correctly define the square causes you to lose your turn, if the you correctly define the square another player then takes a question card and reads it aloud to you. You are entitled to look at the question card after it has been read aloud to you as the answer is not located anywhere on the card.

5. Select the multiple choice answer you believe is the correct answer.

6. Have the player who has read you the question look up the question number in the Master Book to determine whether or not you are correct. Although you may select only one, some questions may have more than one answer. If you have received a Challenge! card you will not have a multiple choice of answers you must arrive at your own conclusion to the predicament on the question card and be elected correct or incorrect by consensus vote of the other players. If a consensus cannot be reached you are then eligible for another question card.

7. If you are CORRECT, you have the opportunity to increase your salary or bonus dollars by the dollar amount shown on the square which you landed on.

Log in the amount on your scorecard, circle the plus ("+") then put your subtotal on the following line.

8. If you are INCORRECT, do the same as above but circle the minus ("–") then put your subtotal on the following line.

9. If you are instructed to go up or down a position (i.e. FAMILY BUSINESS) and your salary is between positions on the SALARY/POSITION CHART on your scorecard then round your position down to the position shown on the chart.

For example:

CURRENT SALARY: $13,000 (between Dispatch & File Clerk)

CORRECT ANSWER ENTITLEMENT: Up 1 Position

NEW SALARY: $15,000-00 (you become a File Clerk at $15,000 salary)

10. If you answer a question incorrectly and this either forces you to drop below a salary of $10,000 or have a negative bonus dollar amount—do nothing.

Every player should, at all times, have a minimum of $10,000 salary and a positive (or zero) amount of bonus dollars.

11. Once the play has been completed with that particular question card, the card must be placed in the back of the question card box and the next question card must be taken from the front of the box in sequential order. Any of the three question types outlined above may be chosen.

12. If a player lands on EMPLOYEE OF THE YEAR or MERIT BONUS, he/she can then add their bonus dollars to their salary and potentially increase their salary significantly, subsequently reducing their bonus dollars total to zero. Otherwise, bonus dollars have no use.

13. If a player lands on SICK LEAVE this player must then appoint another player to answer the question card for him/her. If the other player answers correctly then he/she will have to give $5000 of their salary to the player that landed on SICK LEAVE. If the player who was selected answers the question incorrectly then he/she will have to give $10,000 of their salary to the player that landed on SICK LEAVE.

The player appointed by the player who landed on SICK LEAVE must have a minimum of $20,000 salary in order to be selected due to the fact that no player must be at the risk of falling below the minimum salary of $10,000.

If, at the time, no player has more than $20,000 salary the player that landed on SICK LEAVE is entitled to roll again.

14. If a player lands on BACKSTABBING this player must then appoint another player to answer the question card for him/her. If the other player answers correctly then he/she will receive $5000 salary from the player that landed on BACKSTABBING. If the player who was selected answers the question incorrectly then he/she will have to give $5000 of their salary to the player that landed on BACKSTABBING.

Both players involved in the challenge must have a minimum of $15,000 salary in order to selected due to the fact that no player must be at the risk of failing below the minimum salary of $10,000.

If, at the time, no player has more than $15,000 salary the player that landed on BACKSTABBING is entitled to roll again.

15. When a player has circled the board and approaches the square titled CPI INCREASE one of three situations must occur:

If the player rolls the dice and passes CPI INCREASE, that player receives in salary $1000×the roll of the dice and continues play on the compartment he or she lands on;

If the player lands on CPI INCREASE and answers the question card incorrectly, the player receives in salary $1000×the roll of the dice;

If the player lands on CPI INCREASE and answers the question card correctly, the player receives in salary $2000× the roll of the dice.

16. The first player to achieve a salary of $200,000 is the CHIEF EXECUTIVE OFFICER (C.E.O.) and subsequently the winner.

The game may be played omitting the necessity to define the business predicament which a player has landed on—this should occur only when each and every player is familiar with the correct definition of the business predicaments stated on the board. Moreover, where the participants are familiar with some business issues the questions cars in use can be replaced with a more difficult set of questions or, questions which are specific to sectors of industry and of employment for example medical or retail sectors.

I claim:

1. The apparatus for the game according to the invention comprising:

a game board divided into a plurality of compartments, the compartments being located on the game board in the form of a path to be followed by participants in the game, each compartment including a reference to a respective business predicament and positive/negative consequence indicators;

a plurality of question cards, with each question having a selection of possible answers;

whereby a participant landing on a compartment is required to define the meaning of the business predicament represented in the square, and, on producing an answer deemed to be correct, is required to answer the question on a selected question card, the participant acquiring a positive or negative consequence as a result of correct and incorrect answers respectively.

2. An apparatus for playing a game according to claim 1, wherein the participants in the game are each represented on the game board by a physical token, the tokens being progressively moved around the path formed by the compartments in response to scores fortuitously obtained.

3. A game apparatus according to claim 1, in which the question cards include:

a set of occupational questions having, respectively, data thereon concerning occupations and predicaments specific to any one occupation including multiple choice answers;

a set of general business cards concerning definitions of a variety of business terms and general basis including multiple choice answers; and a set of challenge cards concerning occupational scenarios excluding multiple choice answers.

4. A game apparatus according to claim 1, in which the question cards include:

a set of occupational questions having, respectively, data thereon concerning occupations and predicaments specific to any one occupation including multiple choice answers;

a set of general business cards concerning definitions of a variety of business terms including multiple choice answers; and a set of challenge cards concerning occupational scenarios excluding multiple choice answers;

wherein a definition for each of the business predicaments represented on the board game is provided in a book together with answers to the questions posed on the occupational question card and the general question card.

5. A game apparatus according to claim 1, wherein the question cards are sorted and packaged according to level of difficulty and combined with the game board, the levels of difficulty include but are not limited to categories of simple, varied/general, industry specific, and professional specific.

6. A game apparatus according to claim 1, in which each participant commences the game at a predetermined occupation and salary level, the positive and negative consequences indicated in the compartments including promotion or demotion, salary increases or decreases and bonus dollar increases or decreases.

7. A game apparatus according to claim 1, in which each participant commences the game at a pre determined occupation and salary level, the positive and negative consequences indicated in the compartments including promotion or demotion, salary increases or decreases and bonus dollar increases or decreases, the game progressing by a series of stages until one participant achieves a pre-determined final occupation and salary.

8. A game apparatus according to claim 1, in which the game board is a rectangular board.

9. A game apparatus according to claim 1, in which the business predicaments and question cards shown and used in the game are industry specific and are limited to a range of scenarios which are indicative of one specific occupation.

10. A game apparatus according to claim 1, in which the business predicaments and question cards shown and used in the game are adapted for younger participants, participants with learning or language difficulties or for more highly educated participants.

11. A method of playing a game including the steps of:

providing a game board divided into a plurality of compartments the compartments being located on the game board in the form of a path to be followed by participants in the game, each compartment having associated therewith a reference to a respective business predicament and positive/negative consequence indicators;

selecting an initial starting compartment, each participant, in turn obtaining a score and moving to a respective compartment, the respective compartments being determined by the score obtained;

each participant being required to provide a definition of the business predicament associated with the compartment;

comparing the definition provided by the participant with a supplied correct definition, and if the definition is deemed correct, selecting a question to be answered by the participant, the question relating to a specific occupation or general business matters, the participant acquiring a positive or negative consequence as a result of correct and incorrect answers respectively.

12. A method of playing a game according to claim 11, in which each participant commences the game at a predetermined occupation and salary level, the positive and negative consequences indicated in the compartments including promotion or demotion, salary increases or decreases and bonus dollar increases or decreases.

* * * * *